United States Patent [19]
Ching

[11] 4,318,232
[45] Mar. 9, 1982

[54] HEEL STRUCTURE FOR SHOES

[76] Inventor: Yook J. Ching, 1136 Grant Ave., San Francisco, Calif. 94133

[21] Appl. No.: 126,540

[22] Filed: Mar. 3, 1980

[51] Int. Cl.[3] ..... A43B 13/22; A43B 23/28; A43C 15/00

[52] U.S. Cl. ..... 36/73; 36/59 B; 36/67 D

[58] Field of Search ..... 36/59 B, 67 D, 73, 134

[56] References Cited

U.S. PATENT DOCUMENTS

| | | | |
|---|---|---|---|
| 1,930,874 | 10/1933 | Byrd | 36/73 |
| 3,566,489 | 3/1971 | Morley | 36/67 D |
| 3,911,600 | 10/1975 | Dassler | 36/67 D |

*Primary Examiner*—Patrick D. Lawson
*Attorney, Agent, or Firm*—Alvin E. Hendricson

[57] ABSTRACT

The heel of a shoe is formed with replaceable inserts or knobs that may be formed of material that is the same as or different from the material of the heel and the manner of mounting is such that a user may readily replace the inserts to prevent or limit wear of the shoe heel.

2 Claims, 6 Drawing Figures

HEEL STRUCTURE FOR SHOES

BACKGROUND OF INVENTION

The heels and soles of shoes are subject to wear which then requires replacement of the worn part or discard of the shoes. Normally the heels of shoes evidence the most wear and many types of shoes have the heels separately formed so that the heel may be replaced without resoling the shoe. Other and many newer types of shoes have integral soles and heels. Whatever the type of shoe, the cost of labor is sufficiently high that replacing even the heels of a pair of shoes is quite expensive.

One approach to the foregoing problem has been the provision of protective attachments, sometimes called "taps". These devices are commonly made of metal and may have integral nails therein for driving into the bottoms of soles and heels of shoes usually at the front and back of same. Taps provide only limited protection and are often considered objectionable because of the noise they generate when a person walks on a hard surface while wearing shoes so equipped. While these devices do have a definite utility, they do not solve the basic problem.

Many attempts have been made to provide replacement soles and heels for shoes that may be installed by the user. These replacement items are normally attached by an adhesive in order to preclude the necessity of employing cobblers' tools; however, such items have experienced only limited success. There yet remains the problem of expensive replacement of heels, the most rapidly wearing part of shoes.

SUMMARY OF INVENTION

The present invention provides an improved heel structure for shoes which incorporates a plurality of replaceable elements extending below the bottom plane of the heel. These elements may be cylindrical and fit into mating depressions in the bottom of the heel in such a manner that they are locked therein during use of the shoe but may be replaced by the user.

Removable mounting of the depending elements of the present invention is accomplished in a manner which accommodates ready replacement with the simplest of tools so that the user himself may replace the elements when they become worn without the necessity of paying a skilled artisan to repair the shoe. More than one different mounting arrangement is possible in accordance with the present invention and at least a number of exemplary arrangements are shown and described.

DESCRIPTION OF FIGURES

The present invention is illustrated with respect to preferred embodiments thereof in the accompanying drawings, wherein.

DESCRIPTION OF PREFERRED EMBODIMENT

Figure 1:
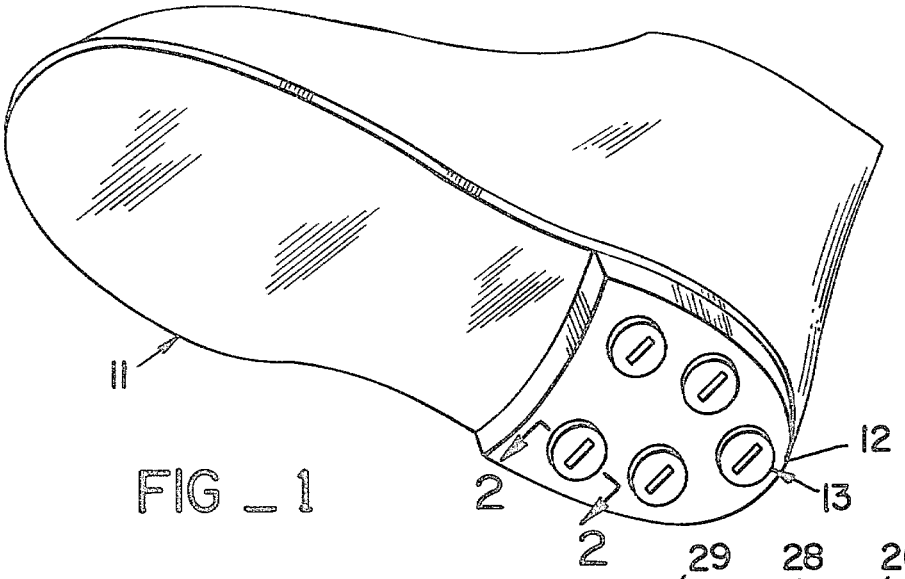
FIG. 1 is a perspective view of a shoe equipped with the present invention.

The present invention, as illustrated in the accompanying drawings, generally comprises a plurality of replaceable inserts adapted to cooperate with the heel of a shoe. There is illustrated in FIG. 1 a shoe 11 having a heel 12 with a plurality of knobs or inserts 13 affixed thereto. The knobs or inserts 13 are adapted to be removeably inserted in the heel 12 and to extend therefrom on the undersurface of the heel so as to protect the heel from wearing during use of the shoe. These knobs or inserts are adapted to be inserted and replaced by the user of the shoe without requiring the assistance of a shoemaker or repairman.

Figure 2:
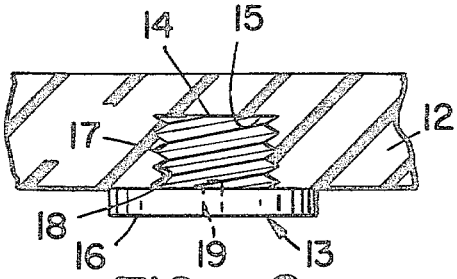
FIG. 2 is a partial sectional view taken in the plane 2—2 of FIG. 1.

Referring now to FIG. 2 of the drawing, there is illustrated a portion of the heel 12 of a shoe 11 with an insert 13 attached thereto. This insert 13 may be provided with a shank 14 adapted to fit into a depression 15 formed in the undersurface of the heel 12. A head 16 is provided on the insert in extension laterally outward about one end of the shank 14. The depression 15 in the heel is dimensioned to receive the shank 14 of the insert and removable engagement of the shank of the heel may be provided for by threads 17 formed about the shank 14 and mating with like threads 18 about the depression 15. A slot 19 is formed in the head 16 for insertion of a screwdriver or the like to thread the insert 13 into the heel and to unthread same from the heel in order to replace the insert.

The insert 13 may be formed of a variety of materials including rubber, although the inserts are preferrably formed of a plastic material having good wearing properties. It will be appreciated that the inserts 13 extend the heads thereof from the undersurface of the heel 12 so that the heads of the inserts engage the ground, floor, etc. upon which the shoe is placed, so that only the inserts are abraided during use of the shoe. This then protects the heel itself from wear so that it is not necessary to replace the heel of the shoe after continued use of the shoe. The inserts 13 are adapted to be readily removed and replaced when the heads thereof are sufficiently worn and this replacement operation is sufficiently simple that the user of the shoe can accomplish same without assistance. It is only necessary to employ a screwdriver and possibly a pair of pliers in order to replace the heel knobs. It is recognized that the heel of a shoe normally experiences the most wear at the undersurface of the shoe. Although heels have been designed for replacement by the owner, it is more common for a shoe repairman to be employed in order to replace a heel. With the present high cost of labor, it has now become quite expensive to replace the heels of shoes and the present invention precludes this necessity by providing readily replaceable extensions or knobs disposed in the heels and absorbing the wear that the heel would otherwise experience.

Figure 3:
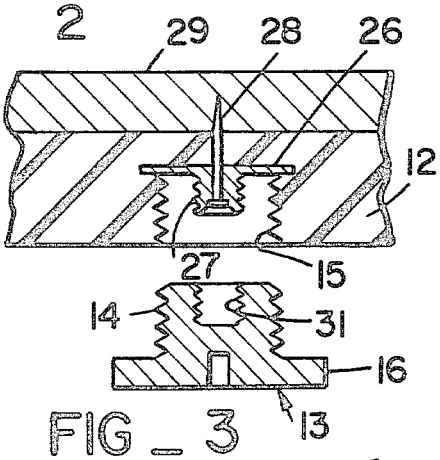
FIG. 3 is a partial sectional view of a shoe heel and attachment in accordance with the present invention.

It will be appreciated that the inserts or knobs of the present invention may be engaged with the heel of a shoe in a variety of manners. Thus, for example, there is illustrated in FIG. 3 an alternative arrangement of the present invention wherein a heel 12 is provided with a threaded depression 15 having at the bottom thereof a metal disc 26 with an externally threaded extension 27 through which a nail 28 is driven to attach the heel to a sole 29 of a shoe. It is common in shoe construction to provide a plurality of metal discs in or on a heel so that nails may be driven through central openings thereof to affix the heel to the sole of the shoe. The present invention provides an extension or protuberance 27 on such a disc 26 for engaging a central indentation 31 in the end of a shank 14 of an insert 13. The shank 14 may be threaded about the exterior thereof for mating with the threaded indentation 15 in the heel. With the insert 13 formed of a hard rubber or plastic, it is possible to thread the insert into the depression 15 to force the metal extension 27 at the bottom of the depression 15 into the indentation 31 in the end of the shank of the insert. This then tends to expand the end of the shank 14 into extremely tight engagement with the inner end of the depression 15 and also to tightly engage the metal extension 27 with the indentation in the end of the shank so that the insert is very firmly locked in the heel with the head 16 of the insert extending from the lower surface of the heel.

Figure 4:
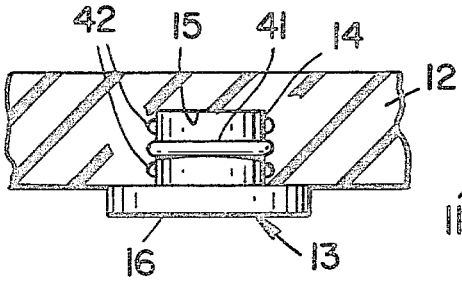
FIG. 4 is a partial sectional view illustrating a further embodiment of the present invention.

A further manner of removeably inserting a heel knob or the like 13 in a heel 12 is illustrated in FIG. 4 wherein the insert 13 is provided with one or more external flanges 41 about the shank 14 thereof. A depression 15 in the heel 12 is provided with annular grooves 42 thereabout of a size and configuration to accommodate mating relationship with the flange or flanges 41 about the insert shank 14. It is thus only necessary to force the shank of the insert into the depression in order to snap the flange or flanges 41 into the grooves 42 in order to lock the insert in the heel 12. Removal of the insert in this instance is accomplished by prying the insert out of the heel as by means of a screwdriver inserted under the head 16 of the insert to lift the insert far enough out of the heel that it can be grasped as by a pair of pliers or the like and then fully removed.

Figure 5:
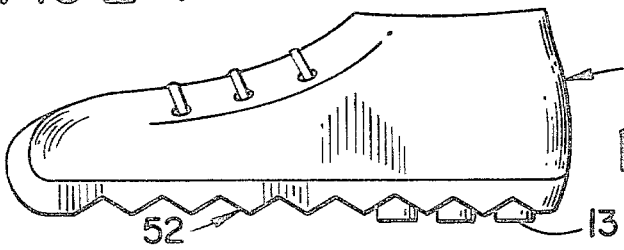
FIG. 5 is an illustration of application of the present invention to an alternative type of shoe.

The present invention is equally applicable to conventional shoe structures such as illustrated in FIG. 1 and alternative structures such as that illustrated in FIG. 5. There have been developed and widely marketed numerous types of shoe structures which do not incorporate a separate heel. Such a shoe 51 is generally illustrated in FIG. 5 wherein the entire undersurface or sole thereof 52 is formed as a single unit which may even extend up about the toe and heel of the shoe. Such a sole 52 may be formed of rubber or the like and may, for example, include transverse ridges and grooves, as illustrated. This type of shoe structure also suffers from maximum wear at the heel portion thereof; however, it is not normally possible to replace the worn portion so that once the rear or heel part of the sole has been worn down, it is necessary to discard the shoe. The present invention is particularly applicable to extend the life of a shoe formed as illustrated in FIG. 5, for example, by the application of inserts 13 in the rear of the sole 52. These inserts 13 may be affixed in a variety of manners such as those illustrated in FIGS. 2 and 4 of the drawings hereof. Additionally, it is possible for these inserts to be provided with other than a circular configuration, particularly in the instance wherein attachment means, such as illustrated in FIG. 4, are employed. It will be appreciated that the embodiment of the present invention illustrated in FIG. 4 does not require a circular shank on the insert, for there is no rotation of the insert employed during attachment or detachment of same.

Figure 6:
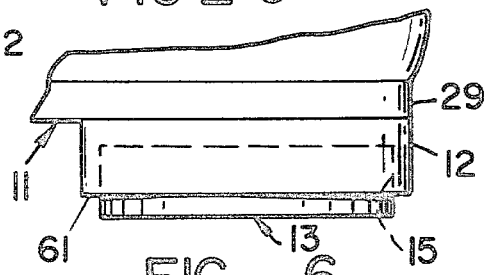
FIG. 6 is a view illustrating a still further embodiment of the present invention.

The present invention has been described above with respect to a number of alternative embodiments thereof; however, it is further noted that additional modifications and variations are possible within the scope of the present invention. Thus, for example, any number of inserts may be employed including a single insert on a single heel of a pair of shoes. Such a single insert 13 may encompass substantially the entire heel area, as illustrated in FIG. 6 of the drawings, or possibly the rear half or the like of a heel area rather than being provided as a plurality of individual inserts. Thus, the number and size of the inserts of the present invention are variable at the determination of the manufacturer. Again referring to FIG. 6, it is noted that the single insert in the heel 12 is provided to mate with a single depression 15 in the heel which occupies substantially the entire heel area, except for a rim 61 about the heel depression. Additionally, it is noted that the insert 13 may have relatively straight sides mating with the straight sides of the heel depression 15. Inasmuch as the heel 12 is normally formed of a deformable rubber, it is possible to form the insert of rubber, for example, with straight sides that may be forced into the depression 15 so that the mating sides of the insert and depression firmly grip the insert to maintain same in the position illustrated in FIG. 6 wherein the insert extends a limited distance below the bottom of the heel 12. It is also to be noted in this respect that the present invention is applicable for use with only a single heel of a pair of shoes, particularly under those circumstances wherein the walking habits of a person wearing the shoes are such that only one heel experiences undue wear.

It will be appreciated that the present invention, as described above, provides a very simple, inexpensive and highly advantageous advance in the art of shoe structure. A semi-permanent attachment of heel knobs or the like with the heel or sole of a shoe is possible in accordance with the present invention and yet, these inserts or knobs may be removed for replacement. The cost of shoe maintenance is consequently minimized by the present invention, for it will be appreciated that the inserts themselves are quite inexpensive and may be replaced by the user of the shoe.

The present invention has been described above with respect and in terms of particular preferred embodiments thereof; however, it will be appreciated by those skilled in the art that the invention encompasses many possible variations and modifications so that it is not intended to limit the invention to the details of illustration or precise terms of description.

What is claimed is:

1. An improved heel structure for a shoe comprising at least one insert with a shank adapted to fit into a heel depression and to replaceably extend therefrom, each of said depressions having a central protuberance in the bottom thereof and each of said inserts having a central longitudinal apperture in the inner end of the shank thereof for tightly fitting on a protuberance in a heel depression to removably lock an insert in a heel depression.

2. The structure of claim 1 further defined by a metal disc locked in the bottom of each heel indentation and including said protuberance with a threaded exterior and said inserts being formed of an indentable material whereby the end apperture thereof tightly fits said threaded protuberance.

* * * * *